US010588390B1

(12) United States Patent
Pichardo

(10) Patent No.: US 10,588,390 B1
(45) Date of Patent: Mar. 17, 2020

(54) MAGNETICALLY-ATTACHED CARRYING BAG BASE

(71) Applicant: Lissa Pichardo, North Baldwin, NY (US)

(72) Inventor: Lissa Pichardo, North Baldwin, NY (US)

( * ) Notice: Subject to any disclaimer, the term of this patent is extended or adjusted under 35 U.S.C. 154(b) by 512 days.

(21) Appl. No.: 15/351,484

(22) Filed: Nov. 15, 2016

(51) Int. Cl.

| | |
|---|---|
| ***A45C 13/00*** | (2006.01) |
| ***A45C 13/10*** | (2006.01) |
| ***A45C 15/06*** | (2006.01) |
| ***A45C 3/04*** | (2006.01) |
| ***A45C 5/14*** | (2006.01) |
| ***F21V 33/00*** | (2006.01) |
| ***F21V 23/04*** | (2006.01) |
| ***F21L 4/00*** | (2006.01) |
| *F21W 131/30* | (2006.01) |
| *F21Y 115/10* | (2016.01) |
| *F21V 1/00* | (2006.01) |

(52) U.S. Cl.
CPC ..... *A45C 13/001* (2013.01); *A45C 3/04* (2013.01); *A45C 5/143* (2013.01); *A45C 13/1069* (2013.01); *A45C 15/06* (2013.01); *F21L 4/00* (2013.01); *F21V 23/0414* (2013.01); *F21V 33/0004* (2013.01); *F21L 2001/00* (2013.01); *F21W 2131/30* (2013.01); *F21Y 2115/10* (2016.08)

(58) Field of Classification Search
CPC ..... A45C 13/001; A45C 3/04; A45C 5/143; A45C 13/1069; A45C 15/06
USPC ..... 190/18 R, 18 A; 280/47.17, 652, 79.2, 280/79.3; 16/29, 30
See application file for complete search history.

(56) References Cited

U.S. PATENT DOCUMENTS

| | | | | |
|---|---|---|---|---|
| 1,042,530 | A | 1/1912 | Lifton | |
| 2,437,382 | A | 3/1948 | Czap | |
| 3,901,360 | A | 8/1975 | Cook | |
| 3,987,875 | A * | 10/1976 | Szabo | A45C 5/14 190/18 A |
| 5,293,975 | A | 3/1994 | Howorka | |
| 7,814,948 | B2 | 10/2010 | Amante | |
| 8,671,519 | B1 * | 3/2014 | Spraley | B60B 33/001 16/30 |
| 8,881,345 | B2 * | 11/2014 | Franze | B60B 33/0018 16/30 |

(Continued)

FOREIGN PATENT DOCUMENTS

WO 2010085089 A2 10/2010

*Primary Examiner* — James N Smalley

(57) ABSTRACT

The magnetically-attached carrying bag case is a colonnade that is adapted for use with luggage. The magnetically-attached carry bag case comprises a plurality of riser mechanisms that are attached to the luggage such that the luggage is raised off of a supporting surface. The purpose of the magnetically-attached carrying bag case is to raise the luggage above any dirt or liquids that may have accumulated on the supporting surface. The plurality of riser mechanisms are magnetically-attached in a detachable manner to the luggage. In a second potential embodiment of the disclosure, the magnetically-attached carrying bag case further comprises a lamp that attaches to the luggage in a manner similar to the plurality of riser mechanisms. The lamp lights the interior of the luggage. The magnetically-attached carrying bag case comprises a plurality of riser mechanisms and a lamp.

16 Claims, 5 Drawing Sheets

(56) References Cited

U.S. PATENT DOCUMENTS

| | | | | |
|---|---|---|---|---|
| 9,707,802 | B1 * | 7/2017 | Abbassi | B60B 33/0018 |
| 2003/0094554 | A1 * | 5/2003 | Bushey | B60B 33/0002 248/223.41 |
| 2003/0127815 | A1 * | 7/2003 | Hall | B60B 33/0002 280/79.3 |
| 2014/0124107 | A1 | 5/2014 | Archer | |

* cited by examiner

MAGNETICALLY-ATTACHED CARRYING BAG BASE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including hand or travel articles, more specifically, a detail or accessory for purses, luggage, or other hand carried bags.

SUMMARY OF INVENTION

The magnetically-attached carrying bag case is a colonnade that is adapted for use with an item of luggage. The magnetically-attached carry bag case comprises a plurality of riser mechanisms that are attached to the item of luggage such that the item of luggage is raised off of a supporting surface. The purpose of the magnetically-attached carrying bag case is to raise the item of luggage above any dirt or liquids that may have accumulated on the supporting surface. The plurality of riser mechanisms are magnetically-attached in a detachable manner to the item of luggage. In a second potential embodiment of the disclosure, the magnetically-attached carrying bag case further comprises a lamp that attaches to the luggage in a manner similar to the plurality of riser mechanisms. The lamp lights the interior of the item of luggage.

These together with additional objects, features and advantages of the magnetically-attached carrying bag case will be readily apparent to those of ordinary skill in the art upon reading the following detailed description of the presently preferred, but nonetheless illustrative, embodiments when taken in conjunction with the accompanying drawings.

In this respect, before explaining the current embodiments of the magnetically-attached carrying bag case in detail, it is to be understood that the magnetically-attached carrying bag case is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the magnetically-attached carrying bag case.

It is therefore important that the claims be regarded as including such equivalent construction insofar as they do not depart from the spirit and scope of the magnetically-attached carrying bag case. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
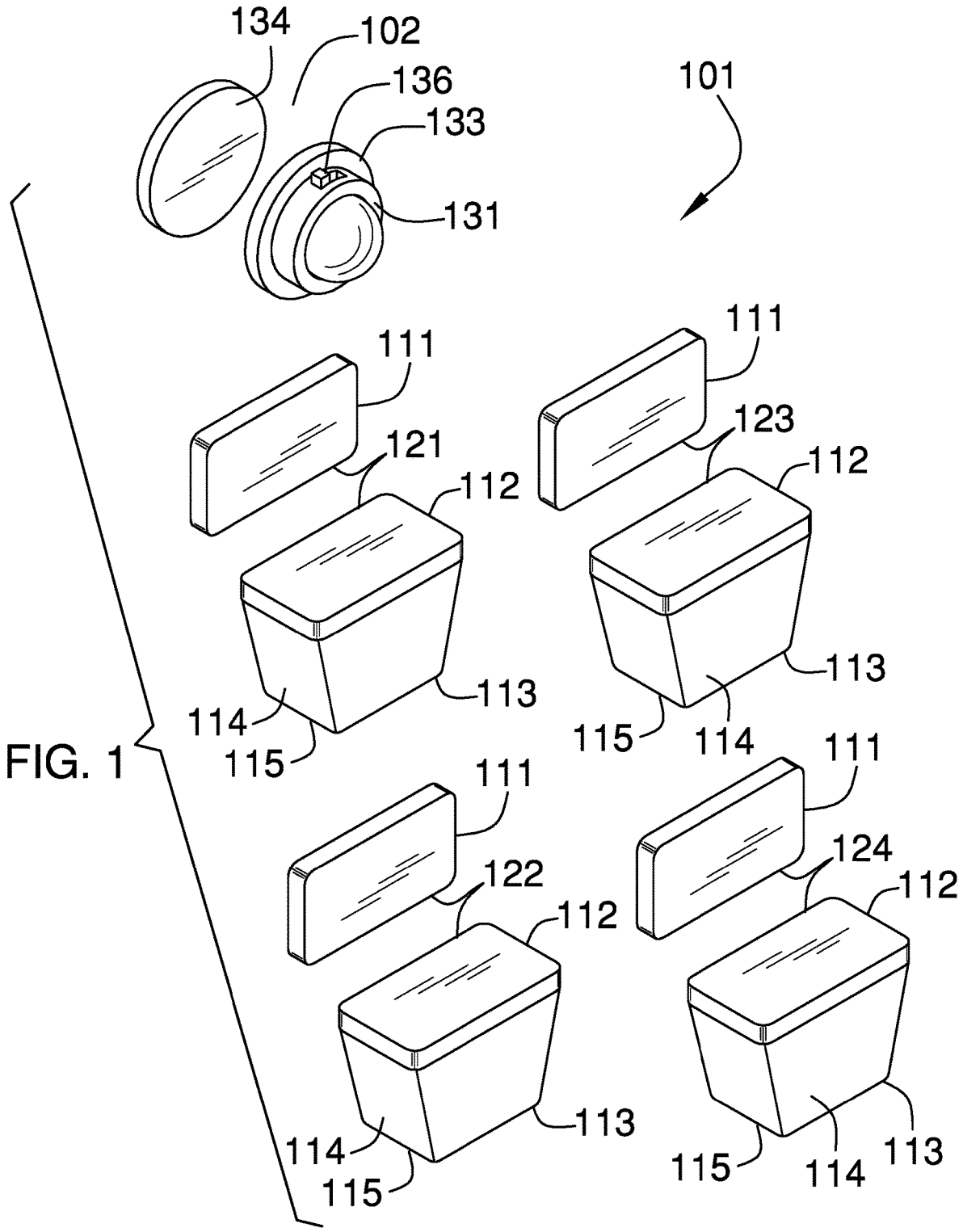
FIG. 1 is a perspective view of an embodiment of the disclosure.
Figure 2:
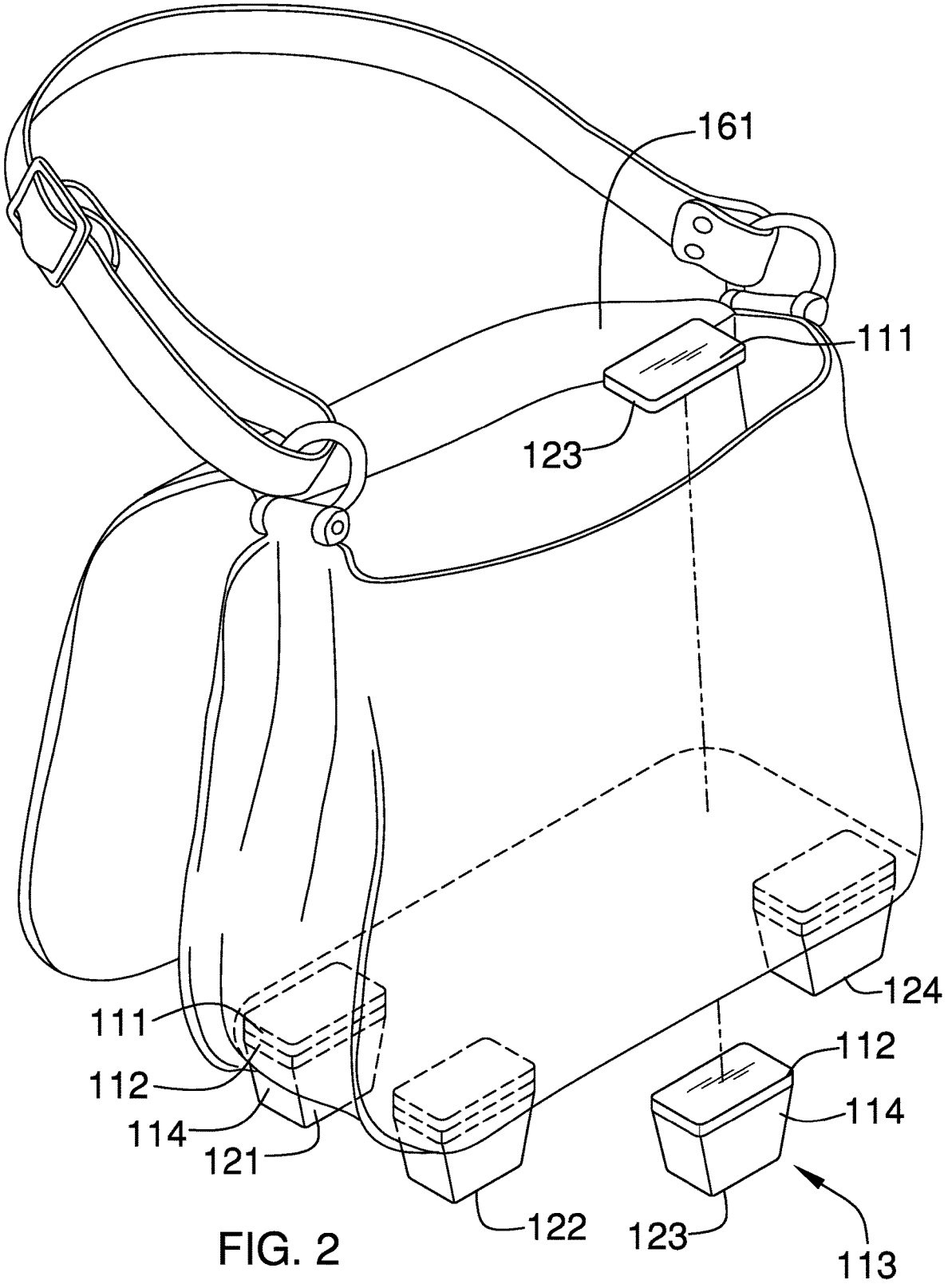
FIG. 2 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The magnetically-attached carrying bag case 100 (hereinafter invention) comprises a plurality of riser mechanisms 101. The invention 100 is a colonnade that is adapted for use with an item of luggage 161. The plurality of riser mechanisms 101 that are attached to the item of luggage 161 such that the item of luggage 161 is raised off of a supporting surface 162 upon which the item of luggage 161 is placed. The purpose of the invention 100 is to raise the item of luggage 161 above any dirt or liquids that may have accumulated on a supporting surface 162. The plurality of riser mechanisms 101 are magnetically-attached in a detachable manner to the item of luggage 161. In a second potential embodiment of the disclosure, the invention 100 further comprises a lamp 102 that attaches to the item of luggage 161 in a manner similar to the plurality of riser mechanisms 101.

Each of the plurality of riser mechanisms 101 comprises a first lock plate 111 and a riser 113. The riser 113 further comprises a lifting member 114 and a second lock plate 112. The second lock plate 112 is permanently attached to the lifting member 114. The first lock plate 111 is a magnetized plate that is formed in the shape of a first rectangular block. The second lock plate 112 is a magnetized plate that is formed in the shape of a second rectangular block. The lifting member 114 is a structure that raises and supports the item of luggage 161 above the supporting surface 162.

Each riser mechanism selected from the plurality of riser mechanisms 101 attaches to the item of luggage 161 by placing the first lock plate 111 against an interior surface 141 of the item of luggage 161. The riser 113 attaches to the first lock plate 111 by placing the riser 113 against the exterior surface 142 of the item of luggage 161 such that the second lock plate 112 magnetically attaches to the first lock plate 111.

In the first potential embodiment of the disclosure, as shown most clearly in FIG. 1, the lifting member 114 is formed in the shape of a truncated pyramid 115. The base of the truncated pyramid 115 attaches to the second lock plate 112 such that the base of the truncated pyramid 115 is proximal to the item of luggage 161 during invention 100 use.

Figure 4:
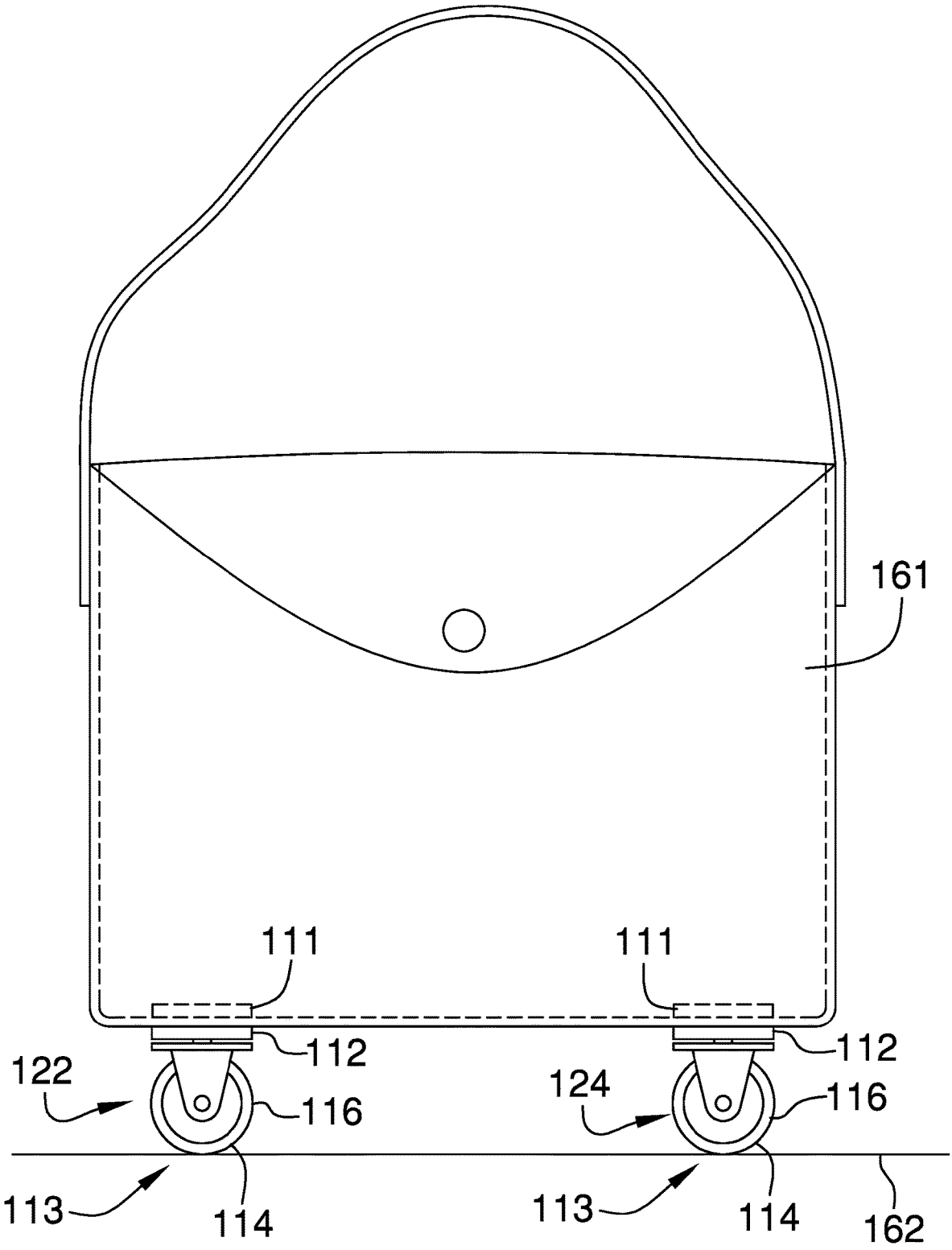
FIG. 4 is a front view of an alternative embodiment of the disclosure.

In a second potential embodiment of the disclosure, as shown most clearly in FIG. 4, lifting member 114 is a readily and commercially available caster 116. The use of casters 116 allows the item of luggage 161 to be rolled across the supporting surface 162.

Figure 3:
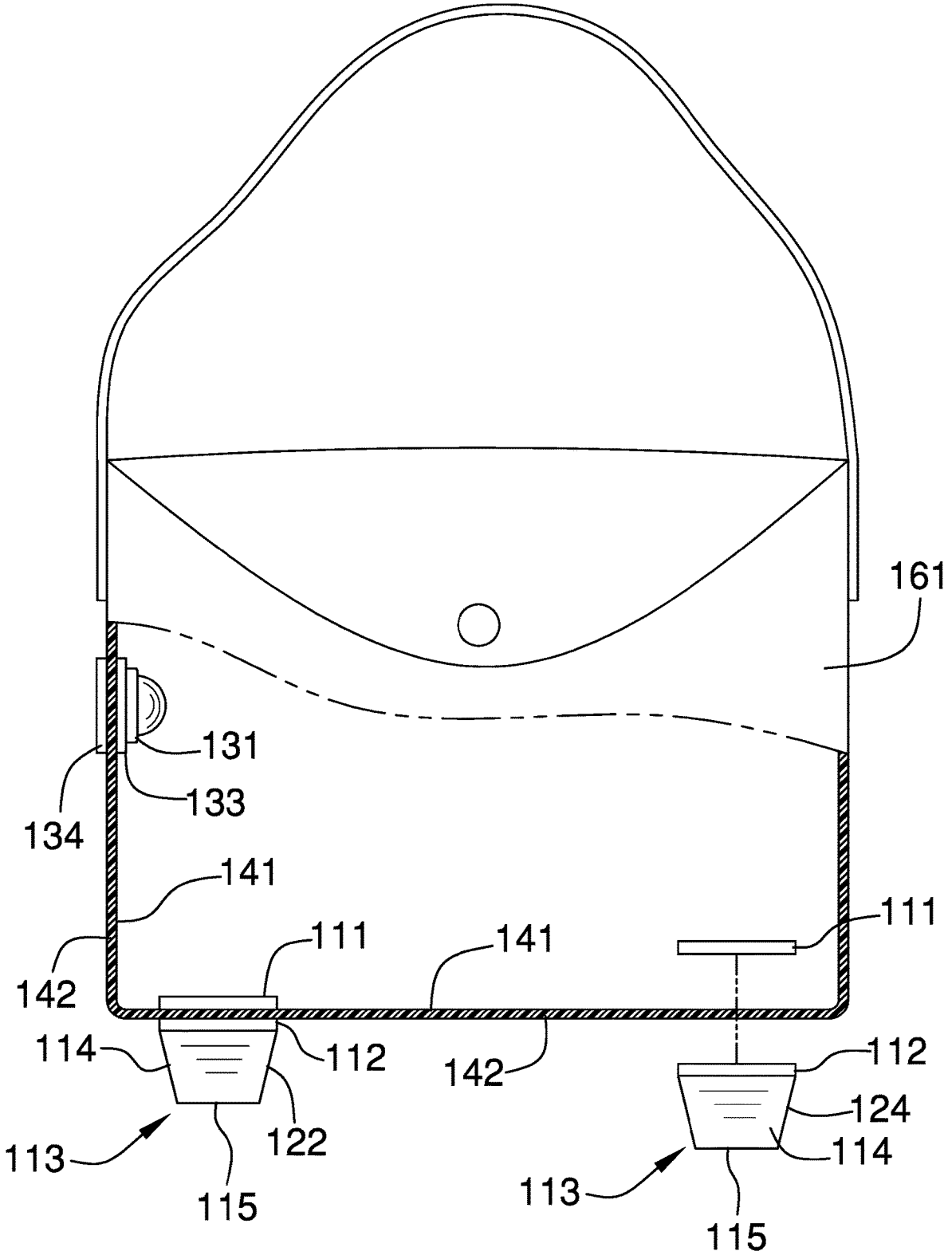
FIG. 3 is a front view of an embodiment of the disclosure.
Figure 5:
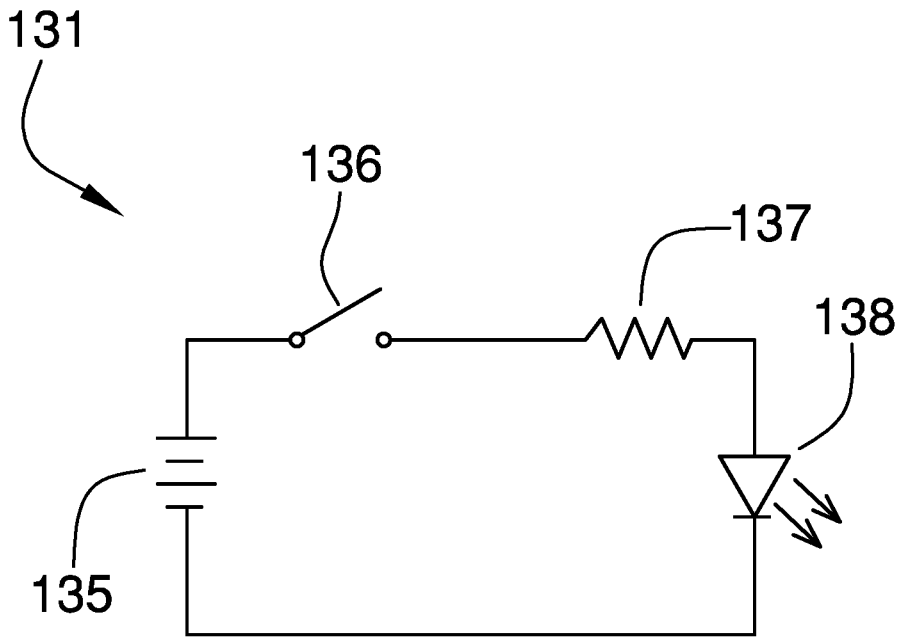
FIG. 5 is a schematic view of an embodiment of the disclosure.

In a third potential embodiment of the disclosure, as shown most clearly in FIGS. 3 and 5, the invention 100 further comprises a lamp 102. The lamp 102 lights the interior of the item of luggage 161. The lamp 102 comprises a circuit 131, a third lock plate 133, and a fourth lock plate 134. The circuit 131 further comprises a battery 135, a switch 136, a limit resistor 137, and an LED 138. As shown in FIG. 5, the circuit 131 is assembled by placing the battery 135, the switch 136, the limit resistor 137, and the LED 138 in a series circuit. The battery 135 provides electric power to the circuit 131. The switch 136 controls the flow of electricity through the circuit 131. The limit resistor 137 limits the amount of electric current the flows through the circuit 131. The LED 138 illuminates when electric current flows through the circuit 131. The third lock plate 133 is a magnetized plate that is formed in the shape of a first disk. As shown most clearly in FIGS. 1 and 3, the circuit 131 is mounted on the third lock plate 133. Methods to house and mount circuits on objects are well known and documented in the electrical arts. The fourth lock plate 134 is a magnetized plate that is formed in the shape of a second disk.

The lamp 102 attaches to the item of luggage 161 by placing the circuit 131 and the third lock plate 133 against an interior surface 141 of the item of luggage 161 such that the third lock plate 133 is between the interior surface 141 and the circuit 131. The fourth lock plate 134 attaches to the third lock plate 133 by placing the fourth lock plate 134 against the exterior surface 142 of the item of luggage 161 such that the fourth lock plate 134 magnetically attaches to the third lock plate 133.

To use the invention 100, the plurality of riser mechanisms 101 comprises a first riser mechanism 121, a second riser mechanism 122, a third riser mechanism 123, and a fourth riser mechanism 124. The first riser mechanism 121, the second riser mechanism 122, the third riser mechanism 123, and the fourth riser mechanism 124 are installed in the item of luggage 161 as described elsewhere in this disclosure. When provisioned, the lamp 102 is installed in the item of luggage 161 as described in this disclosure. When the switch 136 closes, the circuit 131 actuates and the interior of the item of luggage 161 is illuminated by the LED 138.

Details regarding the assembly of all potential embodiments described in this disclosure are provided in this paragraph. The first lock plate 111, the second lock plate 112, the third lock plate 133 and the fourth lock plate 134 are readily and commercially available magnets. The second lock plate 112 attaches to the lifting member 114 using an adhesive. The circuit 131 is formed from readily and commercially available components. The circuit 131 is contained within the readily and commercially available housing and attaches to the third lock plate 133 using an adhesive. Each of the casters 116 is a commercially and readily available caster 116. Each of the truncated pyramids 115 is molded from plastic. Suitable plastics include, but are not limited to, polyvinylchloride or polyethylene.

The following definitions were used in this disclosure:

Battery: As used in this disclosure, a battery is a container consisting of one or more cells, in which chemical energy is converted into electricity and used as a source of power.

Caster: As used in this disclosure, a caster is a wheel that is mounted on a swivel that allows the wheel to adjust, or swivel, the direction of rotation of the wheel to the direction of motion desired for the wheel.

Diode: As used in this disclosure, a diode is a two terminal semiconductor device that allows current flow in only one direction. The two terminals are called the anode and the cathode.

Disk: As used in this disclosure, a disk is a cylindrically shaped object that is flat in appearance.

Exterior: As used in this disclosure, the exterior is use as a relational term that implies that an object is not contained within the boundary of a structure or a space.

Frustum: As used in this disclosure, a frustum is a portion of a solid that lies between two parallel planes that intersect with the solid.

Interior: As used in this disclosure, the interior is use as a relational term that implies that an object is contained within the boundary of a structure or a space.

LED: As used in this disclosure, an LED is an acronym for a light emitting diode. A light emitting diode is a diode that is also a light source.

Pyramid: As used in this disclosure, a pyramid is a three dimensional shape that comprises a base formed in the shape of an N-gon (wherein N is an integer) with N triangular faces that rise from the base to meet at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases which are commonly referred to as cone or an elliptical pyramid respectively.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Truncated Pyramid: As used in this disclosure, a truncated pyramid is a frustum that remains when the apex of a pyramid is truncated by a plane that is parallel to the base of the pyramid.

Truncated: As used in this disclosure, a geometric object is truncated when an apex, vertex, or end is cut off by a plane.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A travel accessory comprising:

a plurality of riser mechanisms;

wherein the travel accessory is a colonnade that is adapted for use with an item of luggage;

wherein the luggage is placed on a supporting surface;

wherein the plurality of riser mechanisms that are attached to the item of luggage such that the item of luggage is raised off of the supporting surface upon which the item of luggage is placed;

wherein the plurality of riser mechanisms are magnetically-attached in a detachable manner to the item of luggage;

wherein each of the plurality of riser mechanisms comprises a first lock plate and a riser;

wherein the first lock plate attaches to the riser in a detachable manner;

wherein the riser further comprises a lifting member and a second lock plate;

wherein the second lock plate is permanently attached to the lifting member.

2. The travel accessory according to claim 1 wherein the first lock plate is a first magnetized plate;

wherein the second lock plate is a second magnetized plate;

wherein the lifting member is a structure that raises and supports the item of luggage above the supporting surface.

3. The travel accessory according to claim 2 wherein the first lock plate of each riser mechanism selected from the plurality of riser mechanisms attaches is placed against a first interior surface of the item of luggage;

wherein the riser of each riser mechanism selected from the plurality of riser mechanisms attaches to the first lock plate by placing the riser against the exterior surface of the item of luggage such that the second lock plate magnetically attaches to the first lock plate.

4. The travel accessory according to claim 3 wherein the lifting member is formed in the shape of a truncated pyramid;

wherein the base of the truncated pyramid attaches to the second lock plate.

5. The travel accessory according to claim 4 wherein the lamp comprises a circuit, a third lock plate, and a fourth lock plate;

wherein the circuit and the fourth lock plate attach to the third lock plate.

6. The travel accessory according to claim 5 wherein the circuit further comprises a battery, a switch, a limit resistor, and an LED;

wherein the circuit is assembled by placing the battery, the switch, the limit resistor, and the LED in a series circuit.

7. The travel accessory according to claim 6 wherein the third lock plate is a magnetized plate;

wherein the fourth lock plate is a magnetized plate.

8. The travel accessory according to claim 7 wherein the third lock plate is placed against a second interior surface of the item of luggage such that the third lock plate is between the second interior surface and the circuit;

wherein the fourth lock plate is placed against the exterior surface of the item of luggage such that the fourth lock plate attaches to the third lock plate.

9. The travel accessory according to claim 7 wherein the first lock plate is formed in the shape of a first rectangular block;

wherein the second lock plate is formed in the shape of a second rectangular block;

wherein the third lock plate is formed in the shape of a first disk;

wherein the fourth lock plate is formed in the shape of a second disk.

10. The travel accessory according to claim 9 wherein the plurality of riser mechanisms comprises a first riser mechanism, a second riser mechanism, a third riser mechanism, and a fourth riser mechanism.

11. A travel accessory comprising:

a plurality of riser mechanisms and a lamp;

wherein the travel accessory is a colonnade that is adapted for use with an item of luggage;

wherein the luggage is placed on a supporting surface;

wherein the plurality of riser mechanisms that are attached to the item of luggage such that the item of luggage is raised off of the supporting surface upon which the item of luggage is placed;

wherein the lamp is attached to the item of luggage such that the interior of the luggage is illuminated;

wherein the plurality of riser mechanisms are magnetically attaches in a detachable manner to the item of luggage;

wherein the lamp magnetically attaches in a detachable manner to the item of luggage.

12. The travel accessory according to claim 11 wherein each of the plurality of riser mechanisms comprises a first lock plate and a riser;

wherein the first lock plate attaches to the riser in a detachable manner;

wherein the riser further comprises a lifting member and a second lock plate;

wherein the second lock plate is permanently attached to the lifting member;

wherein the first lock plate is a first magnetized plate;

wherein the second lock plate is a second magnetized plate;

wherein the lifting member is a structure that raises and supports the item of luggage above the supporting surface;

wherein the first lock plate of each riser mechanism selected from the plurality of riser mechanisms attaches is placed against a first interior surface of the item of luggage;

wherein the riser of each riser mechanism selected from the plurality of riser mechanisms attaches to the first lock plate by placing the riser against the exterior surface of the item of luggage such that the second lock plate magnetically attaches to the first lock plate.

13. The travel accessory according to claim 12 wherein the lamp comprises a circuit, a third lock plate, and a fourth lock plate;

wherein the circuit and the fourth lock plate attach to the third lock plate;

wherein the circuit further comprises a battery, a switch, a limit resistor, and an LED;

wherein the circuit is assembled by placing the battery, the switch, the limit resistor, and the LED in a series circuit;

wherein the battery provides electric power to the circuit;

wherein the switch controls the flow of electricity through the circuit;

wherein the limit resistor limits the amount of electric current the flows through the circuit;

wherein the LED illuminates when electric current flows through the circuit.

14. The travel accessory according to claim 13 wherein the third lock plate is a magnetized plate;

wherein the fourth lock plate is a magnetized plate;

wherein the third lock plate is placed against a second interior surface of the item of luggage such that the third lock plate is between the second interior surface and the circuit;

wherein the fourth lock plate is placed against the exterior surface of the item of luggage such that the fourth lock plate attaches to the third lock plate.

15. The travel accessory according to claim 14 wherein the first lock plate is formed in the shape of a first rectangular block;

wherein the second lock plate is formed in the shape of a second rectangular block;

wherein the third lock plate is formed in the shape of a first disk;

wherein the fourth lock plate is formed in the shape of a second disk.

16. The travel accessory according to claim 15 wherein the plurality of riser mechanisms comprises a first riser mechanism, a second riser mechanism, a third riser mechanism, and a fourth riser mechanism.

* * * * *